United States Patent [19]

Savitsky et al.

[11] Patent Number: 4,654,237

[45] Date of Patent: Mar. 31, 1987

[54] PROCESS FOR CHEMICAL AND THERMAL TREATMENT OF STEEL WORKPIECES

[75] Inventors: Evgeny M. Savitsky, Moscow; Mikhail S. Goikhman, Lvov; Petr M. Khudyk, Lvovskaya; Valery V. Chepkasov, Penza; Valentin V. Sulyagin; Viktoria P. Polyakova, both of Moscow; Viktor F. Shatinsky, Lvov; Nelli B. Gorina, Moscow; Evgeny M. Rudkovsky, Lvov, all of U.S.S.R.

[73] Assignees: Fiziko Mekhanichesky Institut Imeni Karpenko, Lvov; Institut Metallurgii Imeni Baikova Akademii Nauk SSR, Moscow, both of U.S.S.R.

[21] Appl. No.: 773,427

[22] Filed: Sep. 6, 1985

Related U.S. Application Data

[63] Continuation of Ser. No. 629,632, Jul. 11, 1984, abandoned.

[51] Int. Cl.[4] ..... C23C 10/22

[52] U.S. Cl. ..... 427/431; 148/6.11

[58] Field of Search ..... 427/432, 431; 148/6.11

[56] References Cited

U.S. PATENT DOCUMENTS 3,467,545 9/1969 Carter ..... 427/432
3,481,770 12/1969 Lemke ..... 427/432

FOREIGN PATENT DOCUMENTS 964323 7/1964 United Kingdom ..... 427/431

*Primary Examiner*—Sam Silverberg
*Attorney, Agent, or Firm*—Ladas & Parry

[57] ABSTRACT

A process for chemical and thermal treatment of steel workpieces accompanied by the formation thereon of a coating includes diffusive precipitation onto the base metal of the workpiece of an intermetallic compound from a melt of a low-melting-point metal, such as sodium or lithium, at a temperature of from 720° to 820° C. for a duration of time necessary for obtaining a coating layer of required thickness.

3 Claims, No Drawings

PROCESS FOR CHEMICAL AND THERMAL TREATMENT OF STEEL WORKPIECES

This is a continuation of co-pending application Ser. No. 629,632 filed on July 11, 1984 now abandoned.

FIELD OF THE INVENTION

This invention relates generally to the metal science and thermal treatment of metals and alloys. More specifically, the invention relates to processes for chemical and thermal treatment of steel workpieces to obtain coatings by diffusive precipitation.

The process according to the invention can find application for obtaining coatings capable of imitating, in terms of their physical and chemical properties, such precious metals as gold and platinum with the aim of reducing consumption of these metals or using such coatings as alternative materials for parts and components in instrument making (precision friction pairs, electrical contacts, terminals, variable resistor wires), in medicine (for making dentures and surgical tools), in electrical engineering (electrical contacts), in horology (fabricating watch casings, bracelets and watch parts), in jewelry practice (for making decorations and dishware), and in the chemical industry (for protecting parts from corrosion or making them more resistant to heat).

The process according to the invention can also be used during fabrication of reflector screens of various designations and for application of coatings to protect parts from sea-water corrosion.

BACKGROUND OF THE INVENTION

Widely used nowdays are various techniques for obtaining, normally galvanically, precious metal coatings (gold-plating and palladizing). However, galvanizing most often fails to ensure reliable coatings on parts of shaped configuration. Thus, coatings obtained by the known methods are inherently disadvantageous because of low bonding with the base metal, non-uniform thickness especially at the corners of workpieces, low hardness, and susceptibility to wear. Also, application of these known processes necessitates workpiece surface pretreatment, such as mechanical cleaning and pickling.

To improve the physical and chemical properties of coatings, new shop processes have made way to industrial use lately, one such process involving chemical and thermal treatment of metal parts by diffusive precipitation.

Diffusion coatings are surface layers characterized by low porosity and high bonding with the base metal. Diffusion coating processes can provide surface layers of various chemical compositions to guarantee such advantageous properties as high resistance to wear, sufficient hardness, tolerance to corrosive atmosphere, and high mechanical strength.

There is known a process for chemical and thermal treatment of steel workpieces accompanied by the formation of a coating thereon obtained by diffusive precipitation or deposition onto the base metal of a substance from a melt of a low-melting-point metal (cf. USSR Inventor's Certificate No. 582,329; IPC C 23 C 9/10).

Sodium is used as the low-melting-point metal of the melt, whereas platinum is employed as the substance which forms a coating in the course of diffusive precipitation.

Preferred conditions of the diffusive precipitation: temperature—630° to 670° C.; duration—5 to 6 hrs.

Therefore, the aforedescribed process resides in the use of a fusible or low-melting-point metal in which there are introduced other metal elements to precipitate onto the base metal and thus form a diffusion coating. An isothermal process of mass transfer takes place in which the substance is dissolved in the form of metal elements in the melt of fusible metal to be transferred and adsorbed on the surface of the workpiece being coated to bond therewith, and the element(s) are interacted with the metal of the workpiece through diffusion. As a result, a coating is formed on the base metal composed of the elements taking part in the diffusive precipitation.

However, this process fails to provide coatings of predetermined stoichiometric composition with substantially uniform coating layer thickness.

In addition, the use of the known processes of chemical and thermal treatment by diffusive precipitation with precious metals and alternative imitation metals is disadvantageous due to high losses of such metals during the processes.

SUMMARY OF THE INVENTION

It is therefore an object of the present invention to provide a process for chemical and thermal treatment of steel workpieces to obtain on the base metal thereof a coating of a predetermined stoichiometric composition.

Another object is provide a process for chemical and thermal treatment of steel workpieces to obtain on the base metal thereof a coating of predetermined thickness sufficient for meeting the demands of designated service conditions.

One more object is to provide a process for chemical and thermal treatment of steel workpieces to obtain on the base metal thereof a coating which would imitate in physical and chemical properties precious metals, that is a coating possesing high resistance to corrosion and having luster and coloration imitating gold or platinum.

These and other attending objects and advantages are attained by that in a process for chemical and thermal treatment of steel workpieces to form a coating thereon by diffusive precipitation on the base metal of the steel workpiece of a substance from a low-melting-point metal melt according to the invention, the diffusive precipitation process is carried out at a temperature of between 720° and 820° C. for a duration sufficient to obtain a coating layer of required thickness, the melt preferably containing sodium or lithium as the low-melting-point metal, the substance being precipitated having the form of an intermetallic compound.

The use of molten sodium or lithium makes it possible to obviate the need for the workpiece surface pretreatment by pickling, since melts of the above metals act to remove surface oxides and enable to clean workpieces and parts of complex configuration, as well as interior cavities and grooved portions thereof due to the fact that such melts have high wetting power and fluidity. Also, the use of baths of such molten metals makes a subsequent mechanical cleaning of the workpiece surface superfluous, as the remainder of the melt penetrated into slits and clefts of the workpiece can be evacuated by washing the workpiece in water. In addition, the loss of the substance used for precipitating a coating by diffusion is negligeable, because such a substance dissolves in sodium or lithium melts is small quantities, whereas the chemical and thermal treatment process follows a pattern whereby the amount of the substance dissolved in the melt is substantially equal to the amount thereof diposited on the workpiece surface being coated.

Introduced to the melt as a substance being precipitated is an intermetallic compound of stoichiometric composition having predetermined physical and chemical properties, such as compounds capable of imitating precious metals, to enable to obtain coatings composed of the compound introduced into the melt, that is coatings of predetermined composition, since dissolution in the melt, transfer and precipitation of the compound elements takes place according to the stoichiometric proportion corresponding to the composition of the compound introduced, whereby the composition of the coating layer obtained tends to be uniform throughout the thickness thereof.

The process is conducted at a temperature within a range of between 720° and 820° C. Such temperature conditions provide for all the basic physical and chemical processes necessary for ensuring chemical and thermal treatment to take place, particularly, sufficiently vigorous dissolution of various intermetallic compounds in the melt, diffusive transfer of the elements being precipitated from the melt toward the base metal of the workpiece, and formation of coatings having a thickness sufficient to meet the demands imposed by intended service conditions of the workpiece. The thickness of the coating depends on the duration of diffusive precipitation in turn determined by the physical and chemical parameters of the process.

For effecting the process the amount of the intermetallic compound to be introduced into the melt is preferably determined by:

$$G_1=0.03\ G_2+S\cdot\delta\cdot\gamma,$$

where $G_1$=weight of the intermetallic compound, in g;

$G_2$=weight of the low-melting-point metall, in g;

S=surface area of the workpiece being coated, in $cm^2$;

$\delta$=required thickness of the coating layer, in cm; and $\gamma$=density of the intermetallic compound, in $g/cm^3$.

In order to obtain coatings imitating in color platinum and having sufficient resistance to corrosion, tolerance to oxidation at high temperatures, and high mechanical characteristics (hardness and wear resistance), it is advisable for the diffusive precipitation to be conducted at a temperature of from 720° to 780° C. for a duration between 6 and 8 hrs in a molten bath containing lithium and an intermetallic compound of nickel and aluminum.

For obtaining coatings imitating gold the diffusive precipitation is preferably carried out at a temperature between 780° and 820° C. for 6 to 8 hrs in a melt containing sodium and an intermetallic compound of palladium and indium.

Molten sodium likewise provides necessary conditions for obtaining a coating of required properties (sufficient solubility of the compound, deposition of the compound elements on the base metal of the steel workpiece, no visible steel dissolution at a phase combination: intermetallic compound of palladium and indium—sodium—steel).

Preferred process parameters of 780° to 820° C. and the precipitation time of 6 to 8 hrs ensure the deposition of a coating having a thickness practicable for a wide range of applications.

DETAILED DESCRIPTION OF THE INVENTION

The invention will now be described in greater detail with reference to various preferred modes of carrying it out.

A workpiece to be coated is placed into a reaction vessel such as an ampoule fabricated from an inert material (one that fails to dissolve in the molten metal used for precipitating the coating). Thereafter, in a neutral gaseous atmosphere, such as argon, the ampoule is filled with a melt of a low-melting-point alkali metal, such as sodium or lithium, and a substance to be precipitated onto the base metal in the form of an intermetallic compound.

The ampoule is then sealed in the argon atmosphere by welding or joint stopping and placed in a furnace, such as a muffle electric furnace, for the process of diffusive precipitation to be carried out therein at a temperature of from 720° to 820° C. for a duration of time necessary to obtain a layer of coating of required thickness.

The proportion of the intermetallic compound to be present in the melt is determined by:

$$G_1=0.03\ G_2+S\cdot\delta\cdot\gamma,$$

where $G_1$=weight of the intermetallic compound, in g;

$G_2$=weight of the low-melting-point metal, in g;

S=surface area of the workpiece, in $cm^2$;

$\delta$=required thickness of the coating layer, in cm; and $\gamma$=density of the intermetallic compound, in $g/cm^2$.

The first term of the above equation takes account of the amount of compound necessary for saturation of the molten sodium or lithium, and for a wide range of compounds it corresponds to 0.03. $G_2$, that is saturation concentration is ensured by a value of close to 3 mass percent.

The second term of the equation takes account of the amount of compound necessary for dipositing a required thickness of the coating layer, and is determined by the size of the workpiece to be coated, the thickness of the coating layer nd the density of the compound, that is this term establishes a general connection between the geometrical dimensions and the mass of substance through its density.

After holding the ampoule at a temperature providing for diffusive precipitation, and subsequent to cooling, it is opened for the workpiece having a coating deposited thereon to be extracted therefrom and washed in the running water.

In order to obtain a coating which would imitate platinum in terms of color and physical-chemical properties, the workpiece is subjected to diffusive precipitation at a temperature between 720° and 780° C. for 6 to 8 hrs in a molten metal composition comprising lithium and an intermetallic compound of nickel and aluminum, the amount of the compound being determined according to the aforecited equation.

For obtaining a coating which would imitate gold in terms of color and physical-chemical properties, the diffusive precipitation is carried out at a temperature between 780° and 820° C. within 6 to 8 hrs in a melt composed of molten sodium and an intermetallic compound of palladium and indium.

Described hereinbelow are various specific examples of the best mode for carrying out the process according to the invention.

EXAMPLE 1

Placed in an ampoule is a tea-spoonfull of steel of the following composition (in mass percent): C=0.08; Mn=1-2; Cr=17-19; Ni=9-11; Ti=0.7; Fe= the balance, and a sample of intermetallic compound comprising a mixture of palladium and indium in the ratio of 56 to 44 mass percent, respectively, for the ampoule to be filled with molten sodium.

The amount $G_1=5.17$ g of the intermetallic compound is determined by the above equation, where $G_2=150$ g;
$S=37$ cm$^2$;
$\delta=0.0018$ cm; and
$\gamma=10$ g/cm$^3$.

Subsequent to sealing in argon atmosphere, the ampoule is placed into a muffle electric furnace where it is held for 6 hrs at a temperature of 780° C. Thereafter, the ampoule is opened for the workpiece to be retrieved therefrom and washed in the running water.

As a result of the chemical and thermal treatment, a coating is formed on the workpiece which is similar in corrosion resistant properties and luster to gold, this coating layer having a thickness of 18 mkm, a microhardness of between 2,100 and 2,400 MPa, and a gold-pink coloration.

100 hrs of testing in acidic and alkaline media evidenced no coating surface corrosion.

EXAMPLE 2

A distinct from Example 1, an ampoule with a workpiece in the form of a steel ring of the following composition (in mass percent): C=0.24-0.32; Fe=the balance, was subjected to thermal treatment at a temperature of 800° C. for 7 hrs.

The initial data for determining the value of $G_1=1.16$ g of the intermetallic compound (palladium and indium) is found from the above equation, where $G_2=30$ g;
$S=9.4$ cm$^2$;
$\delta=0.0025$ cm; and
$\gamma=10$ g/cm$^3$.

As a result of the chemical and thermal treatment, a coating layer is formed on the steel ring in corrosion resistance and luster imitating gold and having a thickness of 25 mkm, microhardness of between 1,850 and 2,025 MPa, and gold-pink in color. Corrosion resistance property is substantially the same as described with reference to the coating obtained according to Example 1.

EXAMPLE 3

Placed into an ampoule is a watch case of a steel of the following composition (in mass percent): C=0.07-0.13; Fe=the balance, and a sample of an intermetallic compound of palladium and indium proportioned 56 to 44 mass percent, respectively, the ampoule being then filled with molten sodium.

The amount of the intermetallic compound is determined according to the above equation, where $G_2=70$ g;
$S=28$ cm$^2$;
$\delta=0.0035$ cm; and
$\gamma=10$ g/cm$^3$.

As a result, $G_1=3.08$ g.

The ampoule with the aforedescribed content is held in a muffle electric furnace for 8 hrs at a temperature of 820° C.

The resultant chemical reaction and heat treatment produce a coating layer of 35 mkm in thickness and having a microhardness of between 1,800 and 2,100 MPa. The color of the coating thus obtained and corrosion resistance thereof are similar to those indicated with reference to Example 1.

EXAMPLE 4

A tea-spoonfull of steel is placed into an ampoule, the steel having the following composition (in mass percent): C=0.24-0.32; Fe=the balance, and a sample of an intermetallic compound of nickel and aluminum ($G_1=3.35$ g), the ampoule being then filled with molten lithium. The amount of $G_1$ of the intermetallic compound is determined according to the equation mentioned before, where $G_2=82$ g;
$S=37$ cm$^2$;
$\delta=0.004$ cm; and
$\gamma=6$ g/cm$^3$.

Subsequent to sealing of the ampoule in an atmosphere of argon, it is held in a furnace for 6 hrs at a temperature of 720° C. Thereafter, the ampoule is opened and the steel is removed therefrom to be washed in the running water.

The chemical and thermal treatment provides for the formation of a coating layer in corrosion resistance property and luster similar to platinum, a thickness of 40 mkm, and microhardness of between 4,100 and 4,200 MPa. The color of the thus obtained coating is light-grey, while resistance to corrosive acidic and alkaline media is comparable to a chrome-nickel steel.

EXAMPLE 5

Placed into an ampoule is a watch case of a steel having the following composition (in mass percent): C=0.07-0.13; Fe=the balance, and a sample of an intermetallic compound of nickel and aluminum ($G_1=2.9$ g), the ampoule being then filled with molten lithium. The amount of $G_1$ is determined from the equation applicable to the previous examples, where $G_2=40$ g;
$S=28$ cm$^2$;
$\delta=0.010$ cm; and
$\gamma=6$ g/cm$^3$.

The ampoule is held for 7 hrs at a temperature of 750° C.

As a result of chemical and thermal treatment, a coating layer is formed approximating in corrosion resistant properties and luster to platinum and having a thickness of 130 mkm, and microhardness of between 4,500 and 4,800 MPa. The corrosive resistance and color of the thus obtained coating are similar to those produced by the process described in Example 4.

EXAMPLE 6

The process is conducted substantially as described in Example 5, the difference being in that an intermetallic compound of nickel and aluminum in the amount of $G_1=3.38$ g is used determined from the same equation, where $G_2=40$ g;
$S=28$ cm$^2$;
$\delta=0.013$ cm; and
$\gamma=6$ g/cm$^3$.

The ampoule is heat-treated for 8 hrs at a temperature of 780° C.

A coating is formed on the base metal of the workpiece in corrosion resistance and luster similar to platinum and having a thickness of 130 mkm and microhardness of between 4,500 and 4,800 MPa, the color and resistance to corrosion being substantially similar to the coating described with reference to Example 4.

What is claimed is:

1. A process for the formation of an intermetallic compound coating by diffusive precipitation onto a base metal in a melt of sodium or lithium comprising (A) determining the amount of intermetallic compound to be introduced in the melt from:

$$G_1=0.03\ G_2+S\cdot\delta\cdot\gamma,$$

where $G_1$=weight of the intermetallic compound, in g;

$G_2$=weight of the low-melting-point metal, in g;

S=surface area of the workpiece, in $cm^2$;

$\delta$=required thickness of the coating layer, in cm, and $\gamma$=density of the intermetallic compound, in $g/cm^3$;

(B) introducing into the melt elements of the intermetallic compound in a stoichiometric proportion corresponding to the stoichiometric composition of said coating so that the weight of said intermetallic compound introduced in said melt is G;

(C) maintaining the temperature of said melt up from 720° C. to 820° C. for a time necessary to produce a predetermined thickness.

2. A process as defined in claim 1, in which said diffusive precipitation is carried out at a temperature of from 720° to 780° C. for a duration of time of between 6 and 8 hrs in said melt containing lithium and an intermetallic compound of nickel and aluminum.

3. A process as defined in claim 1, in which said diffusive precipitation is carried out at a temperature of from 780° and 820° C. for a duration of time between 6 and 8 hrs in said melt containing sodium and an intermetallic compound of palladium and indium.

* * * * *